US010916842B2

(12) United States Patent
Ai et al.

(10) Patent No.: US 10,916,842 B2
(45) Date of Patent: Feb. 9, 2021

(54) ISOLATORS FOR ANTENNA SYSTEMS AND RELATED ANTENNA SYSTEMS

(71) Applicant: CommScope Technologies LLC, Hickory, NC (US)

(72) Inventors: Bin Ai, Suzhou (CN); Hangsheng Wen, Suzhou (CN); Yan Wang, Suzhou (CN); YiDing Wang, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/575,451

(22) Filed: Sep. 19, 2019

(65) Prior Publication Data

US 2020/0136247 A1 Apr. 30, 2020

(30) Foreign Application Priority Data

Oct. 31, 2018 (CN) ..... 2018 1 1281236

(51) Int. Cl.
*H01Q 1/52* (2006.01)
*H01Q 19/10* (2006.01)
*H01Q 1/38* (2006.01)

(52) U.S. Cl.
CPC ..... *H01Q 1/523* (2013.01); *H01Q 1/38* (2013.01); *H01Q 19/10* (2013.01)

(58) Field of Classification Search
CPC ..... H01Q 1/521; H01Q 1/523; H01Q 1/12; H01Q 1/246; H01Q 1/38; H01Q 19/10; H01Q 1/36; H01Q 1/48; H01Q 21/28
See application file for complete search history.

(56) References Cited

U.S. PATENT DOCUMENTS

| | | | | |
|---|---|---|---|---|
| 6,515,633 | B2 * | 2/2003 | Ippolito | H01Q 1/246 343/795 |
| 9,819,084 | B2 * | 11/2017 | Zimmerman | H01O 9/18 |
| 9,923,280 | B2 * | 3/2018 | Segador | H01Q 9/285 |
| 2017/0310009 | A1 | 10/2017 | Isik et al. | |
| 2018/0248257 | A1 * | 8/2018 | Thotahewa | H01Q 1/246 |
| 2018/0331419 | A1 | 11/2018 | Varnoosfaderani et al. | |

* cited by examiner

*Primary Examiner* — Hoang V Nguyen
(74) *Attorney, Agent, or Firm* — Myers Bigel, P.A.

(57) ABSTRACT

An isolator for an antenna system includes a printed circuit board based parasitic element, where the parasitic element has a functional portion and a first connecting portion, and the functional portion has a printed electrically-conducting segment, and the first connecting portion is configured to engage a base board of the antenna system. The isolator further includes at least one support element configured as a second printed circuit board component, where the support element has a second connecting portion, and the second connecting portion is configured to engage the base board of the antenna system, and the support element is configured to support the parasitic element.

20 Claims, 7 Drawing Sheets

ISOLATORS FOR ANTENNA SYSTEMS AND RELATED ANTENNA SYSTEMS

CROSS-REFERENCE TO RELATED APPLICATION

The present application claims priority to Chinese Patent Application Serial No. 201811281236.1, filed Oct. 31, 2018, the entire content of which is incorporated herein by reference.

FIELD

The present invention relates to isolators for antenna systems. The present invention also relates to antenna systems that include these isolators.

BACKGROUND

Multiple-Input Multiple-Output (MIMO) antenna systems are a core technology for next-generation mobile communications. MIMO antenna systems use multiple arrays of radiating elements for transmission and/or reception in order to improve communication quality. However, as the number of arrays of radiating elements mounted on a reflecting plate or "reflector" of an antenna increases, the spacing between radiating elements of adjacent arrays is typically decreased, which results in increased coupling interference between the arrays. The increase coupling degrades the isolation performance of the radiating elements, which may negatively affect the beam forming (BF) of the antennas.

In order to improve isolation performance, isolators may be provided between the radiating elements. Conventional isolators are usually made of sheet metal and are mounted to a feed board of an antenna system using rivets or bolts. The rivets or bolts may potentially penetrate not only an upper layer of the feed board, but also a lower grounded metal layer of the feed board, thereby electrically connecting the isolator to earth ground. Poor common-grounding may degrade the passive intermodulation (PIM) performance of the antenna system.

In order to achieve a reliable connection, conventional isolators may occupy a large area on the feed board. This may increase the cost of the antenna and may also increase the difficulty in routing transmission line segments in the form of conductive traces on the feed board. In addition, the parasitic elements on these isolators are typically continuous metal strips or metal plates with unitary design and limited function.

SUMMARY

According to a first aspect of the present invention, an isolator for an antenna system is provided. The isolator comprises: a parasitic element configured as a first printed circuit board component, where the parasitic element has a functional portion and a first connecting portion, and the functional portion has a printed electrically-conducting segment, and the first connecting portion is configured to engage a base board of the antenna system; and at least one support element configured as a second printed circuit board component, where the support element has a second connecting portion, and the second connecting portion is configured to engage the base board of the antenna system, where the support element is configured to support the parasitic element to extend forwardly from the base board of the antenna system. The support element may also be configured to mount the parasitic element to extend forwardly from the base board of the antenna system.

This configuration is advantageous in that different elements may have their own main functions optimized. Further, as the parasitic element and the support element can be designed separately, the isolator may be constructed to adapt to different application scenarios.

In some embodiments, the support element may physically support the parasitic element on at least one side of the parasitic element. The support element may support the parasitic element on both sides of the parasitic element in some embodiments.

In some embodiments, the parasitic element and the support element may be configured as separate printed circuit boards.

In some embodiments, a plurality of support elements may be provided. For example, two support elements may be provided, in which one of the support elements is pressed against one side of the parasitic element, and the other support element is pressed against the other side of the parasitic element to support the parasitic element from both sides. The support elements may be constructed differently from one another so as to adapt to different application scenarios.

In some embodiments, the parasitic element and the support element may be engaged by intersection. This means of engagement is advantageous in that the isolator can be fixedly connected to the base board in two directions, enabling a more reliable connection of the isolator to the base board.

In some embodiments, an angle between an extension plane of the parasitic element and an extension plane of the support element may be between 80° and 100°.

In some embodiments, the angle between the extension plane of the parasitic element and the extension plane of the support element may be greater than 10°, 20°, 30°, 40°, 50°, 60°, 70° or 80°; and/or the angle between the extension plane of the parasitic element and the extension plane of the support element may be less than 170°, 160°, 150°, 140°, 130°, 120°, 110" or 100°.

In some embodiments, the first connecting portion and the second connecting portion may be configured for insertion through the base board of the antenna system.

In some embodiments, at least one of the first connecting portion and the second connecting portion may have a conductive pad configured for soldering the corresponding connecting portion to the base board.

In some embodiments, the first connecting portion and the second connecting portion may each have a tab that is configured to be inserted into respective slots in the base board of the antenna system.

In some embodiments, the tabs may be disposed below the corresponding pads.

In some embodiments, the pads may be soldered to pads on an upper surface of the base board. This can reduce or even eliminate interference such as PIM caused by common grounding.

In some embodiments, the parasitic element may have a first engagement slot, and/or the support element may have a second engagement slot.

In some embodiments, the parasitic element and the support element may be engaged by intersection through at least one of the first and second engagement slots.

In some embodiments, the support element may be radially snap-fit in the first engagement slot of the parasitic element, and the second engagement slot of the support element may be axially snap-fit onto the parasitic element, for example, onto the extension portion and/or the first connecting portion, thereby achieving engagement of the parasitic element with the support element. This means of engagement is simple and facilitates assembly, significantly improving the assembling efficiency of the isolator.

In some embodiments, the first engagement slot may be positioned between the functional portion and the first connecting portion.

In some embodiments, the parasitic element may have an extension portion between the functional portion and the first connecting portion.

In some embodiments, the extension portion may be tapered towards the first connecting portion.

In some embodiments, the extension portion may be configured eccentrically with respect to the functional portion, or the extension portion may be configured centrally with respect to the functional portion.

In some embodiments, the support element may have at least two second connecting portions.

In some embodiments, the support element may have at least one second connecting portions on either side of the parasitic element.

In some embodiments, at least one of the second connecting portions may be spaced apart from the first connecting portion of the parasitic element by a gap.

In some embodiments, the gap may be configured to span at least one feed trace on the base board of the antenna system.

In some embodiments, the base board may be a feed board of the antenna system.

In some embodiments, the support element and the parasitic element may be engaged via soldering, threaded connection, or an adhesive.

In some embodiments, the electrically-conducting segment on the parasitic element may be configured as a printed copper or aluminum wire.

In some embodiments, the electrically-conducting segment may be configured as a straight line-shaped electrically-conducting segment, a C-shaped electrically-conducting segment, a J-shaped electrically-conducting segment or an arc-shaped electrically-conducting segment.

In some embodiments, the electrically-conducting segment may be configured as a symmetric electrically-conducting segment or an asymmetric electrically-conducting segment.

In some embodiments, the electrically-conducting segment may be configured as a continuous electrically-conducting segment or a discrete electrically-conducting segment.

According to a second aspect of the present invention, an isolator for an antenna system is provided. The isolator comprises: a first printed circuit board component that includes a first connecting portion that is configured to engage a feed board of the antenna system and a printed electrically-conducting segment thereon; and a second printed circuit board component that includes a second connecting portion that is configured to engage the feed board, wherein the second printed circuit board component is configured to mount the first printed circuit board component to extend forwardly from the feed board.

In some embodiments, the first connecting portion may be configured to extend in a first direction and the second connecting portion may be configured to extend in a second direction that is different from the first direction.

In some embodiments, the first connecting portion may be a first tab that is configured to be received within a first slot in the feed board, and the second connecting portion may be a second tab that is configured to be received within a second slot in the feed board.

In some embodiments, the first slot may extend in the first direction and the second slot may extend in the second direction, and the first direction and the second direction may intersect at an angle of between 45° and 135°.

In some embodiments, the first direction and the second direction may intersect at an angle of between 80° and 100°.

In some embodiments, the printed electrically-conducting segment may be electrically floating.

According to a third aspect of the present invention, an antenna system is provided. The antenna system comprises at least one of the isolators for an antenna system according to the present invention. In some embodiments, the antenna system has a plurality of radiating elements, with at least one of the isolators being disposed between at least two of the radiating elements.

By proper design of the configuration of the parasitic elements and the supporting elements, the printed circuit board can be used at high utilization rate. For example, the extension portion of the parasitic element may extend eccentrically with respect to the functional portion up to the first connecting portion. The extension portion is, for example, mostly located on the right side of the parasitic element, such that the area on the left side of the parasitic element not in use may be used for configuration of the support element.

The first printed circuit board component and the second printed circuit board component may each includes a dielectric base board which may comprise, for example, a fiberglass base board formed of a material such as FR-4. Other types of base boards, such as paper base boards (FR-1, FR-2), composite base boards (CEM series) or special material base boards (ceramic, metal base, etc.), may also be used in other embodiments.

DETAILED DESCRIPTION

Figure 1:
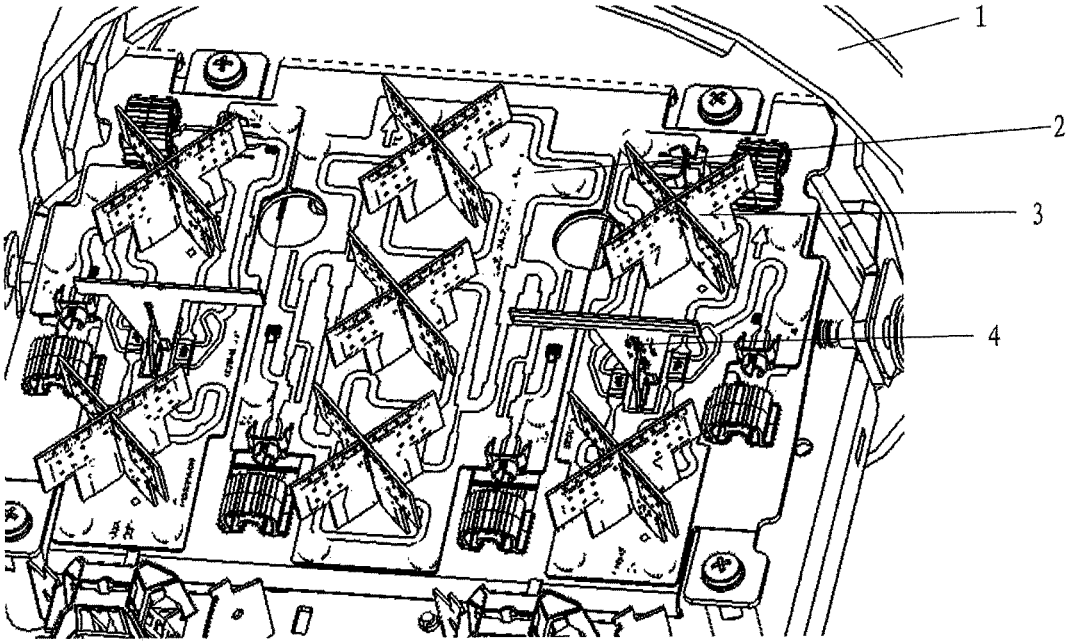
FIG. 1 is a partial view of an antenna system with an isolator according to an embodiment of the present invention.

Embodiments of the present invention will be described below with reference to the drawings, in which several embodiments of the present invention are shown. It should be understood, however, that the present invention may be implemented in many different ways, and is not limited to the example embodiments described below. In fact, the embodiments described hereinafter are intended to make a more complete disclosure of the present invention and to adequately explain the scope of the present invention to a person skilled in the art. It will also be understood that the embodiments disclosed herein can be combined in various ways to provide many additional embodiments.

It should be understood that the wording in the specification is only used for describing particular embodiments and is not intended to limit the present invention. All the terms used in the specification (including technical and scientific terms) have the meanings as normally understood by a person skilled in the art, unless otherwise defined. For the sake of conciseness and/or clarity, well-known functions or constructions may not be described in detail.

The singular forms "a/an" and "the" as used in the specification, unless clearly indicated otherwise, all contain the plural forms. The words "comprising", "containing" and "including" when used in the specification indicate the presence of the claimed features, but do not preclude the presence of one or more additional features. The wording "and/or" as used in the specification includes any and all combinations of one or more of the items listed.

In the specification, words describing spatial relationships such as "up", "down", "left", "right", "front", "back", "high", "low" and the like may describe a relationship of one feature to another feature in the drawings. It should be understood that these terms also encompass different orientations of the apparatus in use or operation, in addition to encompassing the orientations shown in the drawings. For example, when the apparatus shown in the drawings is turned over, the features previously described as being "below" other features may be described to be "above" other features at this time. The apparatus may also be otherwise oriented (rotated 90 degrees or at other orientations) and the relative spatial relationships will be correspondingly altered.

It should be understood that, in all the drawings, the same reference signs refer to the same elements. In the drawings, for the sake of clarity, the sizes of certain features may be modified.

Referring now to FIG. 1, a partial view of an antenna system with an isolator according to an embodiment of the present invention is shown. As shown in FIG. 1, the antenna system includes a radome support 1 that supports a radome (not shown), a feed board 2, and one or more radiating arrays. Each radiating array includes a plurality of radiating elements 3 that are mounted on the feed board 2. The radiating arrays, and hence the radiating elements 3, may operate at the same or different operating frequencies. For example, some of the radiating elements 3 may be low-band radiating elements that operate in the 617 MHz to 960 MHz frequency band, or one or more portions thereof, others of the radiating elements 3 may be mid-band radiating elements that operate in the 1710 MHz to 2690 MHz frequency band, or one or more portions thereof, and additional of the radiating elements 3 may be high-band radiating elements that operate in the 3 GHz or 5 GHz frequency bands, or one or more portions thereof. The radiating elements 3 may act as transmitting elements that transmit radio frequency (RF) signals and/or may act as receiving elements that receive RF signals.

The feed board 2 may be mounted on a reflector of the antenna. Typically, an antenna will include multiple smaller feed boards rather than a single larger feed board. While base station antennas come in different sizes, cellular operators typically limit the maximum width of a base station antenna. Consequently, as the number of radiating arrays that are included in an antenna is increased, the spacing between the radiating elements 3 typically is decreased. This reduced spacing between adjacent radiating elements results in reduced isolation between radiating arrays, and hence increased interference between the radiating arrays. The impact of this interference may be particularly problematic when the radiating elements 3 are arranged in the near field.

Figure 2:
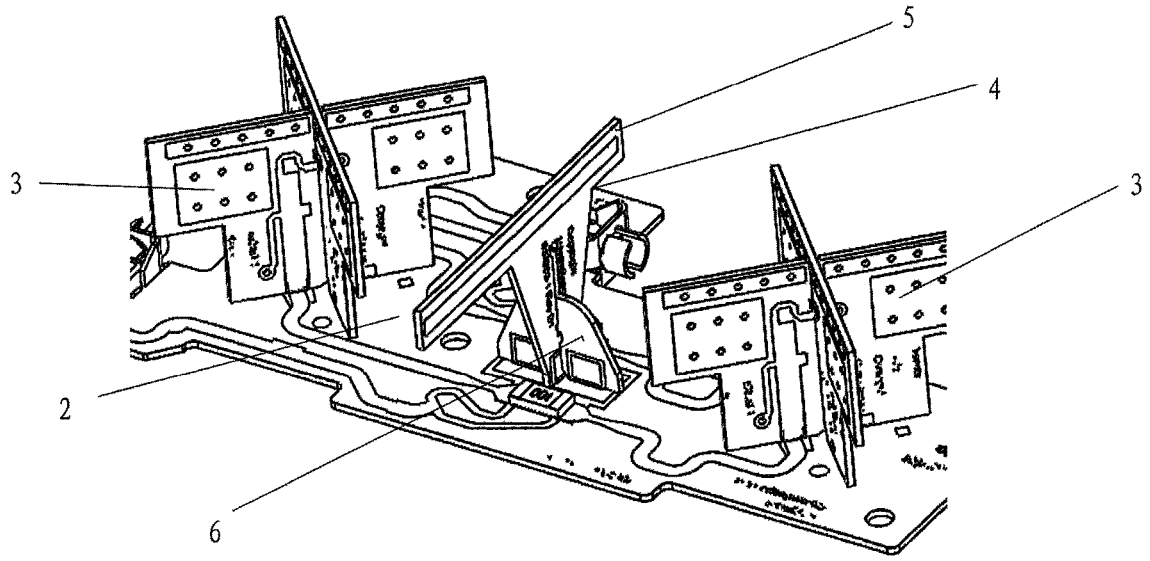
FIG. 2 is a further enlarged partial view of the antenna system with the isolator shown in FIG. 1.

In order to reduce the above-mentioned interference effects, an isolator 4 may be positioned between adjacent radiating elements 3. Referring now to FIG. 2, a further partial view of the antenna system of FIG. 1 is shown. As shown in FIG. 2, an isolator 4 is positioned between two adjacent radiating elements 3. The isolator 4 is mounted on the feed board 2. The feed board 2 may, in many cases, have complex transmission line patterns (also referred to as "conductive traces" or "feed traces" herein) routed thereon. As known to those of skill in the art, a feed trace is provided on the feed board for each radiating element 3. If the radiating elements are cross-polarized radiating elements, each radiating element 3 will typically have two associated feed traces. Thus, as the number of the radiating elements 3 on the feed board 2 increases, the complexity of the feed trace routing also typically increases, and there may be less open space (i.e., space free of feed traces) on the feed board 2. As such, it may become difficult to mount additional functional elements such as fasteners, isolators, engaging elements or the like on the feed board 2. As also can be seen from FIG. 2, the isolator 4 is positioned within a gap between two feed traces that are between two adjacent radiating elements 3. In this way, the isolation, in particular the coplanar polarization isolation, between the adjacent radiating elements 3 may be improved.

Next, a configuration of the isolator 4 will be further explained with reference to FIGS. 3, 4, 5*a*-5*e* and 6.

Figure 3:
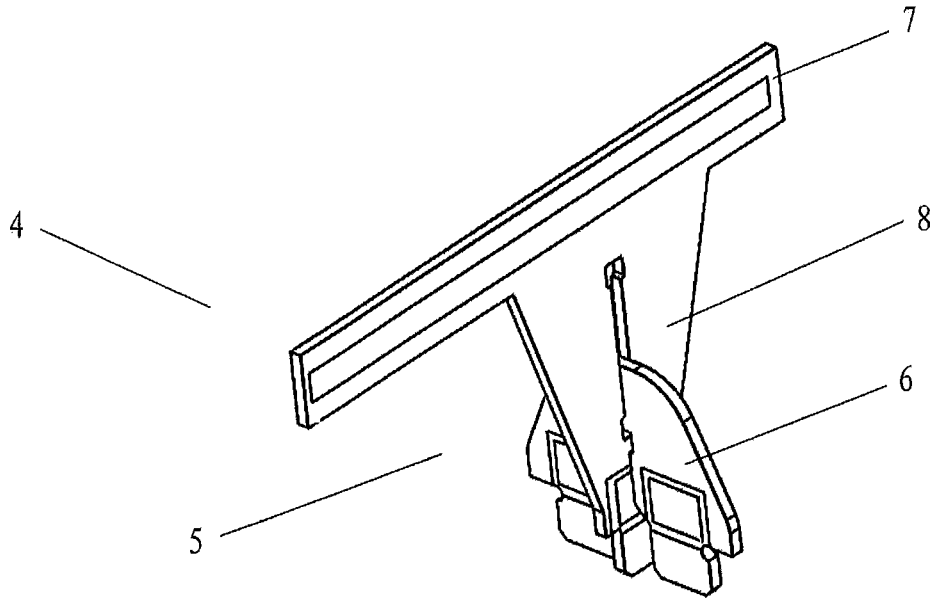
FIG. 3 is a schematic perspective view of one of the isolators according to the embodiment of the present invention that is included in the antenna system of FIGS. 1-2.

As shown in FIG. 3, the isolator 4 includes a parasitic element 5 and a support element 6. The parasitic element 5 and the support element 6 are constructed separately. This separate configuration is advantageous in that each element 5, 6 can have its function optimized. For example, the parasitic element 5 mainly functions to improve the isolation between the radiating elements, and the support element 6 mainly functions to support the parasitic element 5 so that the isolator can be stably mounted on the feed board 2. Additionally, the parasitic element 5 and the support element 6 of the isolator 4 can be designed separately. This allows the isolator 4 to inexpensively be designed and manufactured in a wider variety of forms to adapt to different application scenarios.

As shown in FIG. 3, the parasitic element 5 may be constructed as a first printed circuit board component, and the support element 6 may be constructed as a second printed circuit board component. These two printed circuit board components may be formed from a single printed circuit board. The first printed circuit board component and the second printed circuit board component may each includes a dielectric base board which may comprise, for example, a fiberglass base board formed of a material such as FR-4. Other types of base boards, such as paper base boards (FR-1, FR-2), composite base boards (CEM series) or special material base boards (ceramic, metal base, etc.), may also be used in other embodiments.

In the present example, it is advantageous that the parasitic element 5 and the support element 6 are constructed as rigid printed circuit board components, since flexible printed circuit boards may be expensive, and may need to be held in a fixed position once installed and used, and may accordingly require an additional structural support element. However, it will be understood that in other embodiments, a single flexible printed circuit board component may be used to form the parasitic element 5 extending in a first direction and the support element 6 extending in a second direction. In the implementation of such flexible printed circuit, the first direction may remain intersected with the second direction, for example, at an included angle greater than 40°, 50°, 60°, 70° or 80°.

Figure 4:
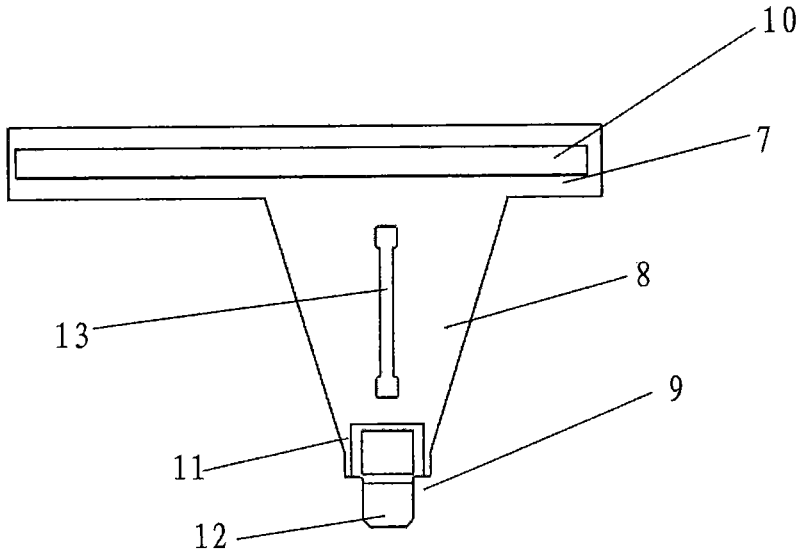
FIG. 4 is a schematic side view of a parasitic element of the isolator of FIG. 3.
Figure 5A:
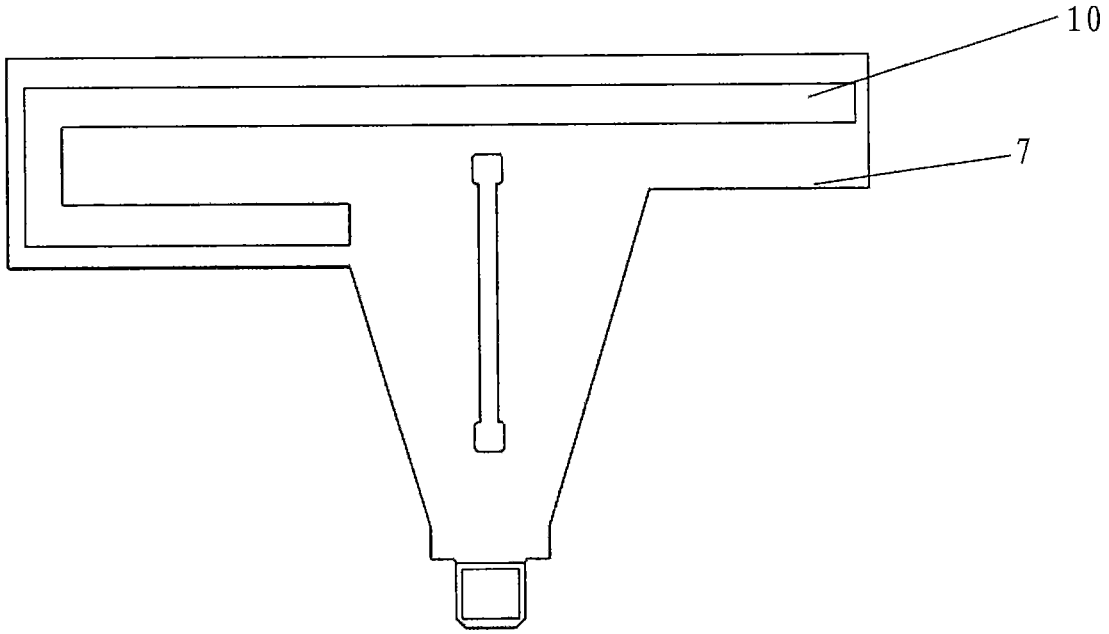
FIGS. 5*a* to 5*e* are schematic side views of additional parasitic elements that may be included in the isolators according to embodiments of the present invention.
Figure 5B:
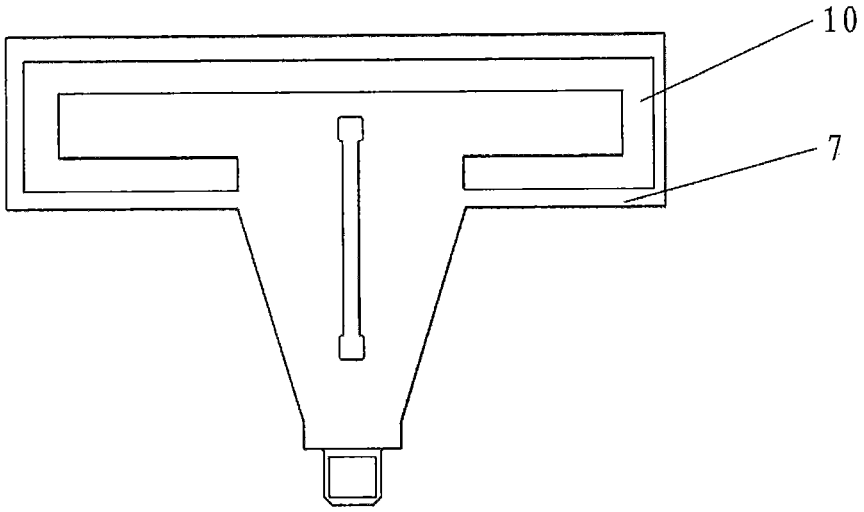
Figure 5C:
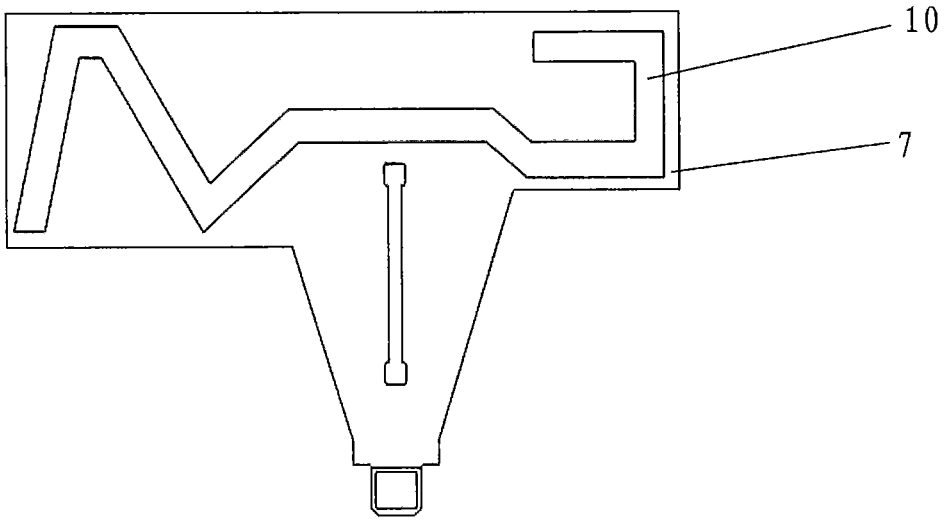
Figure 5D:
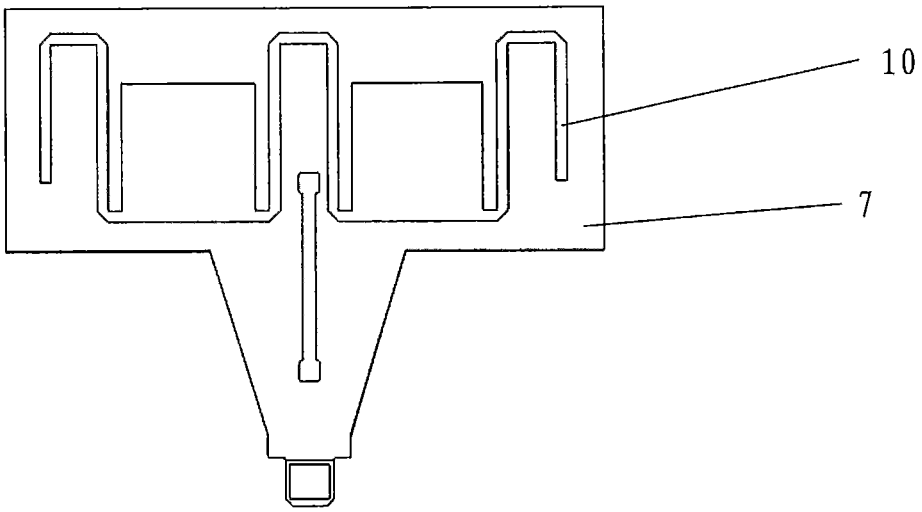
Figure 5E:
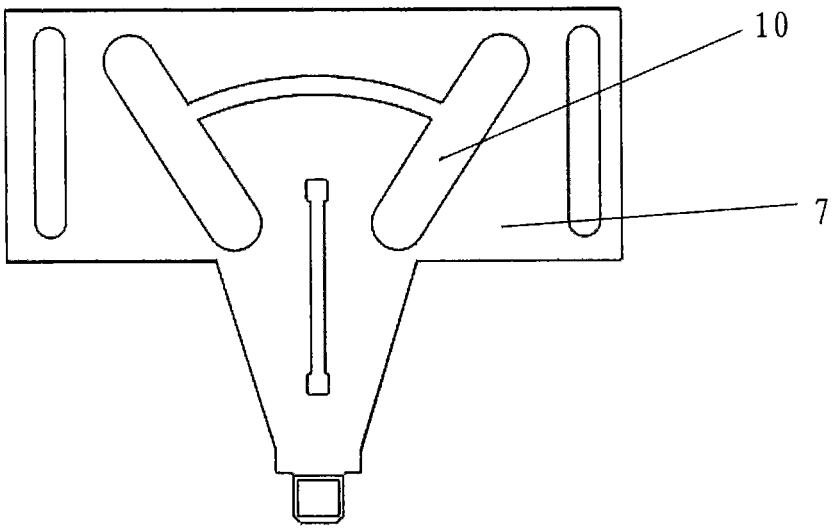

As shown in FIG. 4, the parasitic element 5 may include a functional portion 7, an extension portion 8, and a connecting portion 9. The functional portion 7 extends outwardly from the extension portion 8, and is substantially configured as a rectangular portion in the present embodiment. The functional portion 7 is provided with a printed electrically-conducting segment 10. In the present embodiment, the electrically-conducting segment 10 is a printed copper wire. Of course, in other embodiments, the electrically-conducting segment 10 may also be other printed metal wires, such as aluminum wires.

The electrically-conducting segment 10, which acts as a functional element with a main function of reducing interference, and is substantially located between the radiating arms of two adjacent radiating elements 3. The electrically-conducting segment 10 mainly functions to improve the isolation between the two adjacent radiating elements 3 such that interference between the adjacent radiating elements 3 can be reduced. For example, in order to reduce interference, the electrically-conducting segment 10 may be conductive for radio-frequency energy within a first frequency range and reflective or resistive for radio-frequency energy within a second frequency range. Additionally or alternatively, the electrically-conducting segment 10 may exhibit different filtering characteristics, such as band pass filtering characteristics, band stop filtering characteristics, etc., for radio-frequency signals incident on its surface.

In the present embodiment, the electrically-conducting segment 10 is designed as a straight line-shaped printed copper wire, the length of which may be selected based on a desired filtering characteristic.

In order to achieve different characteristics, the electrically-conducting segment 10 may also be designed in various forms. As shown in FIGS. 5*a* to 5*e*, in other embodiments, the electrically-conducting segment 10 may also be designed as a J-shaped electrically-conducting segment, a C-shaped electrically-conducting segment, an arc-shaped electrically-conducting segment, or even as an irregular electrically-conducting segment. The electrically-conducting segments 10 may be configured as symmetrical electrically-conducting segments, as in FIGS. 5*b*, 5*d* and 5*e*. The electrically-conducting segments 10 may also be configured as asymmetrical electrically-conducting segments, as in FIGS. 5*a* and 5*c*. Further, the electrically-conducting segments 10 may be configured as continuous electrically-conducting segments, as in FIGS. 5*a*, 5*b*, 5*c* and 5*d*. Alternatively, the electrically-conducting segments 10 may be configured as discrete electrically-conducting segments, as in FIG. 5*e*.

The various different electrically-conducting segments 10 that may be included on the isolators 4 according to embodiments of the present invention may bring about a series of advantages: as it is easy to print various forms of electrically-conducting segments 10 on the printed circuit board, the electrically-conducting segments 10 may be flexibly achieved in diverse forms, thereby able to well adapt to the actual application situations. Further, technicians may simulate various forms of the electrically-conducting segments at the beginning of the design so as to perform a preliminary test on the function of the electrically-conducting segments 10 and then make a flexible modification based on the test result, so that the isolation effect of the electrically-conducting segments 10 can be improved.

As shown in FIGS. 4 and 5*a* to 5*e*, the connecting portion 9 of the parasitic element 5 has a tab 12 that is configured for insertion into a corresponding slot in the feed board 2. The connecting portion 9 of the parasitic element 5 also has a pad 11 that is positioned above the tab 12. A pad 11 may be provided on only one side of the parasitic element 5, or pads 11 may be provided on both sides of the parasitic element 5. The pad 11 is configured for soldering the connecting portion 9 to a corresponding pad on the feed board 2 such that the parasitic element 5 can be physically mounted on the feed board 2 and electrically connected to the feed board 2.

The parasitic element 5 further includes an extension portion 8 extending axially between the functional portion 7 and the connecting portion 9. The axial extent of the extension portion 8 may be adapted to a height of the radiating element such that the electrically-conducting segment 10 on the functional portion 7 can isolate adjacent radiating elements 3 from one another. The extension portion 8 may extend eccentrically with respect to the functional portion 7 up to the connecting portion 9, as shown in FIG. 4, in which the extension portion 8 is mostly located on the right side of the parasitic element 5. Of course, the extension portion 8 may also extend centrally with respect to the functional portion 7 up to the connecting portion 9, that is, the extension portion 8 may be substantially located in the middle region over the width of the parasitic element 5, as shown in FIGS. 5*a* to 5*e*.

In FIGS. 4 and 5*a* to 5*e*, the extension portion 8 tapers towards the connecting portion 9. In other words, the extension portion 8 has a width that gradually decreases from the functional portion 7 to the connecting portion 9.

In the present embodiment, the width of the connecting portion 9 is substantially equal to the minimum width of the extension portion 8. Further, the fiberglass base board may have a thickness of, for example, about 0.7 mm, significantly reducing the area of the parasitic element 5 on the feed board 2. As such, the parasitic element 5 may be flexibly positioned at different locations on the feed board 2, for example, in a gap between two feed traces on the feed board 2.

This flexible arrangement can facilitate optimization of performances of the antenna system. For example, after manufacture, the functional element 7 of a parasitic element 5 may be replaced with a different functional element if sufficient isolation was not achieved. Since the parasitic element 5 occupies a very small area on the feed board 2, it is possible to perform debugging at various possible locations.

In other embodiments, the extension portion 8 may also be configured in other shapes, such as a rectangular shape, a trapezoidal shape, etc.

Further, as shown in FIGS. 4 and 5*a* to 5*e*, the parasitic element 5 may have a first engagement slot 13, which may be provided between the functional portion 7 and the connecting portion 9, that is, on the extension portion 8. The first engagement slot 13 is configured to engage the support element 6 that supports the parasitic element 5.

Figure 6:
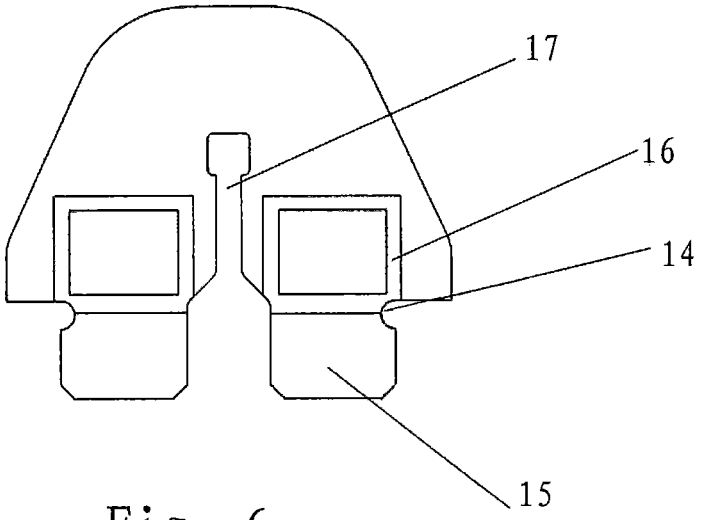
FIG. 6 is a schematic view of a support element of the isolator of FIG. 3.

As shown in FIG. 6, the support element 6 has two connecting portions 14. The connecting portions 14 of the support element 6 each have a tab 15 configured for insertion within a respective slot in the feed board 2. A pad 16 is positioned above each connecting portion 14. The pads 16 may be provided on only one side of the parasitic element 5, or may be provided on both sides of the parasitic element 5. The pads 16 are configured for soldering the connecting portions 14 to corresponding pads on the feed board 2 in order to physically mount the support element 6 on the feed board 2 and to electrically connect the support element 6 to the feed board 2.

As shown in FIG. 6, the support element 6 may include a second engagement slot 17 that may be positioned between the two connecting portions 14. The second engagement slot 17 is configured for engagement with the parasitic element 5.

As shown in FIG. 3, the parasitic element 5 and the support element 6 are mated together by inserting the support element 6 through the first engagement slot 13 in the parasitic element 5. The second engagement slot 17 in the support element 6 passes through the first engagement slot 13 of the parasitic element 5 and the support element 6 is snap-fitted into the first engagement slot 13. Further, the second engagement slot 17 of the support element 6 is snap-fitted to the extension portion 8 and the connecting portion 9. In this way, engagement of the parasitic element 5 with the support element 6 is achieved. This engagement mechanism is simple and facilitates assembly, greatly improving the assembling efficiency of the isolator 4.

In the present embodiment, the first engagement slot 13 of the parasitic element 5 extends substantially over the entire extension portion 8. In other embodiments, the first engagement slot 13 of the parasitic element 5 may also extend only over a lower section of the extension portion 8.

Of course, other types of engagement mechanisms may be used. For example, the support element 6 and the parasitic element 5 may engage each other via soldering, threaded connection, or an adhesive.

Further, the support element 6 may also have a single connecting portion 14 or more than two connecting portions 14. For example, the support element 6 may have a total of four connecting portions 14 with two connecting portions 14 at either side of the parasitic element 5 in another embodiment.

Figure 7:
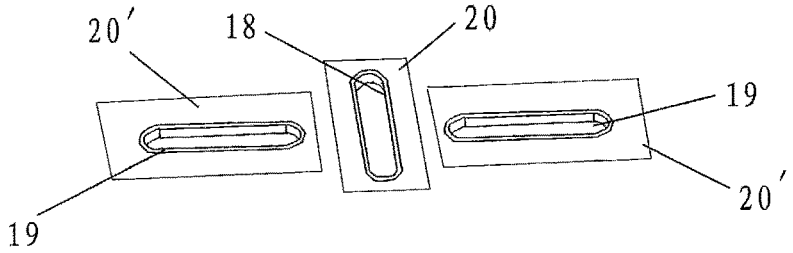
FIG. 7 is a partial view of a feed board that includes mounting slots for mounting isolators according to embodiments of the present invention.

FIG. 7 illustrates a series of slots that may be provided in the feed board 2 of the antenna system that may be used to mount the isolator 4 on the feed board 2. In the present embodiment, three slots 18, 19 are provided in the feed board 2. The slot 18 in the middle extends in a first direction, and the slots 19 on opposed sides of the slot 18 extend in a second direction. The first direction may be substantially perpendicular to the second direction. The slot 18 in the middle is configured to engage the connecting portion 9 of the parasitic element 5. The slots 19 are configured to engage the connecting portions 14 of the support element 6, respectively.

Having the parasitic element 5 engage the feed board 2 in a first direction and the support element 6 engage the feed board 2 in a second direction that is substantially perpendicular to the first direction may be advantageous in that the isolator 4 can be fixedly connected to the feed board 2 in both directions, enabling a more reliable connection of the isolator 4 to the feed board 2. In other embodiments, the first direction and the second direction may have an arbitrary included angle in between, such as an included angle greater than 40°, 50°, 60°, 70°, or 80°.

As is further shown in FIG. 7, a pad 20 is provided that surrounds the slot 18. The pad 20 is configured to be soldered to the pad 11 of the connecting portion 9. A pair of pads 20' are provided that surround the respective slots 19. The pads 20' are configured to be soldered to the pads 16 of the connecting portions 14. In the present embodiment, the tab 12 of the connecting portion 9 is inserted into the slot 18 in the middle on the feed board 2, and if necessary, penetrates through the feed board 2. Similarly, the tabs 15 of the connecting portions 14 are inserted into the slots 19 on both sides on the feed board 2 respectively, and if necessary, penetrate through the feed board 2.

In the present embodiment, the electrical connection (e.g., soldering) between each isolator 4 and the feed board 2 occurs only on an upper surface of the feed board 2, i.e., on the corresponding pads 20, 20' on the feed board 2. Therefore, the isolators 4 are not commonly grounded. Further, as the tab 12 of the connecting portion 9 and the tabs 15 of the connecting portions 14 are all non-electrically conductive, even if they penetrate through the feed board 2, they will not form an electrical connection with the ground copper layer of the feed board 2. The above-described approach for mounting the isolators 4 on the feed board 2 is advantageous in that it can reduce or even eliminate interference such as PIM caused by common grounding of the isolators 4.

Figure 8A:
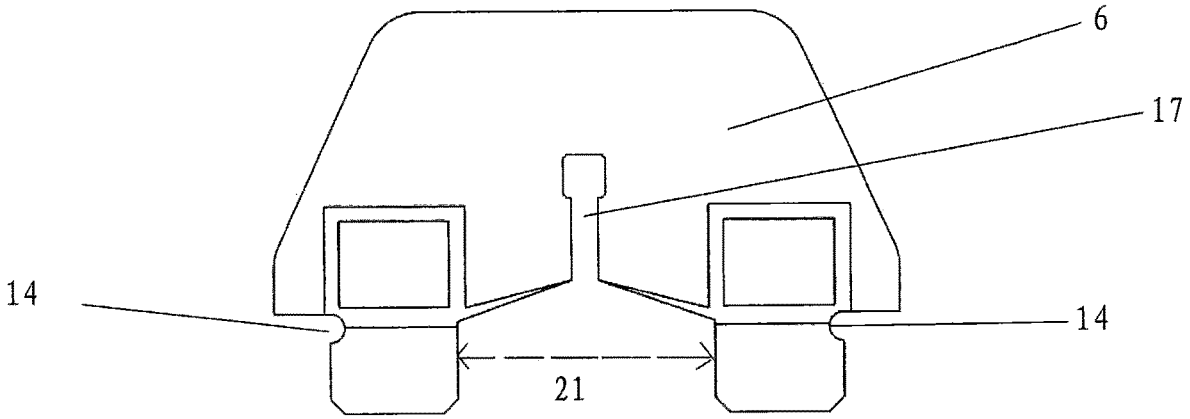
FIG. 8*a* is a schematic side view of the support element of the isolator of FIG. 3.
Figure 8B:
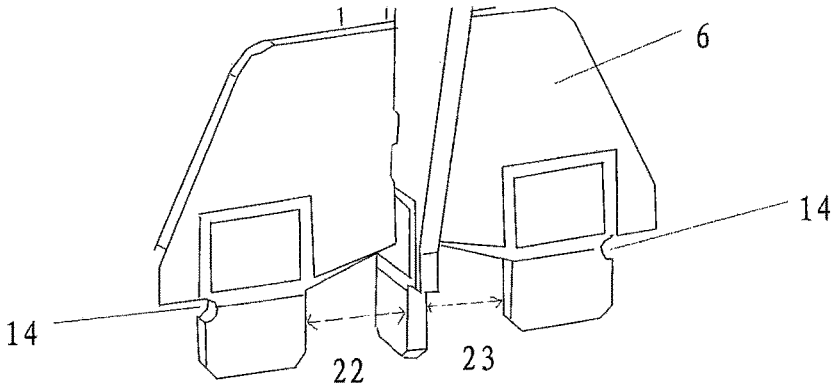
FIG. 8*b* is a schematic perspective view of isolator of FIG. 3 showing gaps between the various connecting portions thereof.

As shown in FIGS. 8*a* and 8*b*, a gap 21 is present between the two connecting portions 14 of the support element 6 and, in particular, between the two tabs 15. In the engaged state, the connecting portion 14 on the left side is spaced apart from the parasitic element 5 by a first gap 22, and the connecting portion 14 on the right side is spaced apart from the parasitic element 5 by a second gap 23. These gaps 22, 23 may be configured to span feed traces on the feed board 2 of the antenna system.

Figure 9:
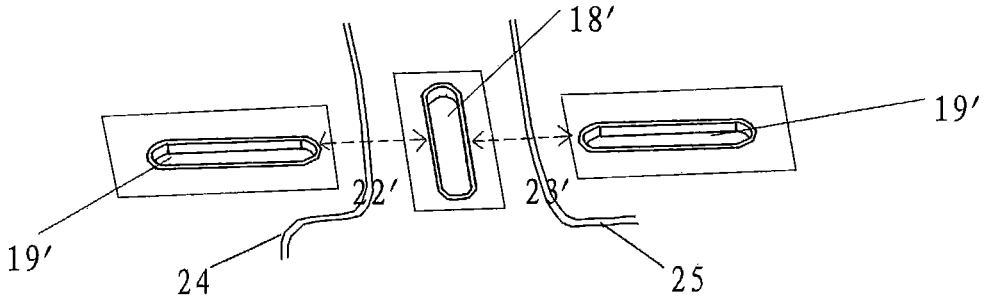
FIG. 9 is a partial view of another arrangement on the feed board for engagement of the isolator.

Accordingly, as shown in FIG. 9, the gaps separating the three slots 18', 19' in the feed board 2 may be modified to allow for the routing of feed traces along the gaps. As shown in FIG. 9, the slot 19' on the left side is spaced apart from the slot 18' in the middle by a first gap 22' that is sufficiently wide to accommodate a feed trace 24, and the slot 19' on the right side is spaced apart from the slot 18' in the middle by a second gap 23' that is sufficiently wide to accommodate a feed trace 25.

In the present embodiment, the first gap 22' is substantially equal to the second gap 23'. In other embodiments, for example, when multiple feed traces are present between the slot 19' on the left side and the slot 18' in the middle, the first gap 22' may be significantly larger than the second gap 23'. In still other embodiments, the second gap 23' may be significantly larger than the first gap 22'.

Figure 10:
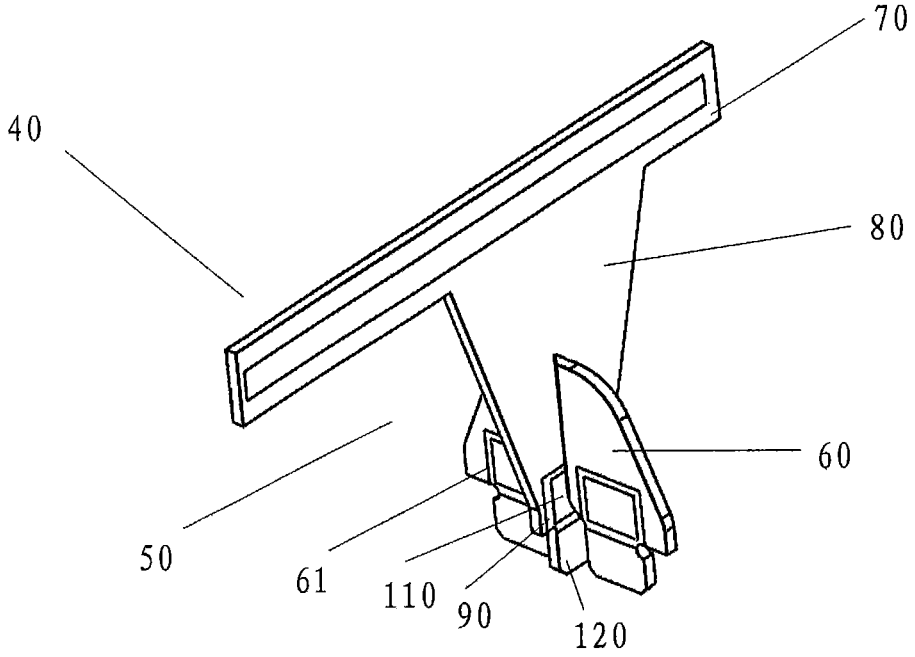
FIG. 10 is a schematic perspective view of another isolator according to embodiments of the present invention.

Next, an isolator according to the embodiments of the present invention will be explained with reference to FIG. 10. As shown in FIG. 10, the isolator 40 includes a parasitic element 50 and two support elements 60, 61. The parasitic element 50 and the support elements 60, 61 are constructed separately. The parasitic element 50 is configured as a first printed circuit board component, the first support element 60 may be configured as a second printed circuit board component, and the second support element 61 may be configured as another second printed circuit board component.

As shown in FIG. 10, the parasitic element 50 includes a functional portion 70, an extension portion 80, and a connecting portion 90. The functional portion 70 extends outwardly from the extension portion 80. The connecting portion 90 has a tab 120 configured for insertion within a slot in the feed board 20. The connecting portion 90 of the parasitic element 50 also has a pad 110 that is positioned above the tab 120. The pad 110 may be provided only on one side of the parasitic element 50, or pads 110 may be provided on both sides of the parasitic element 50. The pad 110 is configured for soldering the connecting portion 90 to the feed board 20 in order to mount the parasitic element 50 on the feed board 20.

Unlike the previously mentioned configuration, the first support element 60 and the second support element 61 do not pass through a slot in the parasitic element 50. The first support element 60 is pressed against one side of the extension portion 80, and the second support element 61 is pressed against the other side of the extension portion 80 so as to support the parasitic element 50 from both sides.

In other embodiments, the support elements may be constructed differently from one another. For example, the connecting portion of the first support element 60 may be spaced apart from the parasitic element 50 at a relatively larger gap in order to provide enough space for the routing of multiple feed traces on this side.

In other embodiments, the support element may also be provided on only one side. It is of course also possible to provide more support elements on one side and fewer support elements on the other side.

Although the exemplary embodiments of the present invention have been described, a person skilled in the art should understand that, multiple changes and modifications may be made to the exemplary embodiments without substantively departing from the spirit and scope of the present invention. Accordingly, all the changes and modifications are encompassed within the protection scope of the present invention as defined by the claims. The present invention is defined by the appended claims, and the equivalents of these claims are also contained therein.

That which is claimed is:

1. An isolator for an antenna system, comprising:

a parasitic element configured as a first printed circuit board component, wherein the parasitic element has a functional portion and a first connecting portion, and the functional portion has a printed electrically-conducting segment, and the first connecting portion is configured to engage a base board of the antenna system; and at least one support element configured as a second printed circuit board component, wherein the at least one support element has a second connecting portion, and the second connecting portion is configured to engage the base board of the antenna system, wherein the at least one support element is configured to support the parasitic element to extend forwardly from the base board of the antenna system, wherein the parasitic element is mounted to intersect the at least one support element, and wherein the at least one support element has a distal end residing behind the functional portion and in front of the first connecting portion of the parasitic element.

2. The isolator for an antenna system according to claim 1, wherein the first connecting portion and the second connecting portion are configured for insertion through the base board of the antenna system.

3. The isolator for an antenna system according to claim 2, wherein the first connecting portion and the second connecting portion each have a tab that is configured to be inserted into respective slots in the base board of the antenna system, wherein a first slot in the base board is configured to receive a tab of the first connecting portion of the first printed circuit board component and is perpendicular to second and third slots in the base board that are configured to receive tabs of the second connecting portion of the second printed circuit board component, and wherein the first slot resides between the second and third slots.

4. The isolator for an antenna system according to claim 1, wherein the first connecting portion has a first conductive pad and the second connecting portion has second and third conductive pads, each configured for soldering to the base board, wherein the first pad is perpendicular to the second and third pads and resides in a slot in the second printed circuit board component, behind a slot in the first printed circuit board component.

5. The isolator for an antenna system according to claim 4, wherein the pads are soldered to pads on a front surface of the base board.

6. The isolator for an antenna system according to claim 1, wherein the parasitic element has a first engagement slot and the at least one support element has a cooperating second engagement slot, wherein the second engagement slot has a first width, perpendicular to a length direction, that is above first and second tabs of the at least one support element and has a second larger width along a length of the first and second tabs, and wherein the first engagement slot has a width that is less than the first width.

7. The isolator for an antenna system according to claim 6, wherein the first engagement slot is positioned between the functional portion and the first connecting portion and terminates in front of the first connecting portion and behind the functional portion.

8. The isolator for an antenna system according to claim 1, wherein the parasitic element has an extension portion between the functional portion and the first connecting portion.

9. The isolator for an antenna system according to claim 8, wherein the extension portion is tapered towards the first connecting portion, and wherein the functional portion has a forward end that has a first laterally extending side that is longer than an opposing second laterally extending side and with a closed slot that is perpendicular to the laterally extending first and second sides residing a distance behind the forward end and in front of the first connecting portion and with the closed slot residing between the first and second laterally extending sides.

10. The isolator for an antenna system according to claim 1, wherein the at least one support element has at least two second connecting portions that are laterally spaced apart with the parasitic element therebetween, wherein the at least two second connecting portions each comprise a notch in front of a tab with the tab residing on one side of the base board and the notch spanning a thickness of the base board, and wherein the at least one support element further comprises a conductive pad above each tab.

11. The isolator for an antenna system according to claim 10, wherein the second connecting portions is spaced apart from the first connecting portion of the parasitic element by a gap.

12. The isolator for an antenna system according to claim 11, wherein the gap is configured to span at least one feed trace on the base board of the antenna system.

13. The isolator for an antenna system according to claim 1, wherein an angle between an extension plane of the parasitic element and an extension plane of the support element is between 80° and 100°.

14. An antenna system, comprising:

a feed board comprising feed traces and a plurality of spaced apart slots;

a plurality of spaced apart dipole radiating elements coupled to the feed board; and a plurality of isolators coupled to the feed board, wherein one isolator is positioned between neighboring dipole radiating elements, and wherein the isolators each comprise:

a first printed circuit board component that includes a first connecting portion that is configured to engage a feed board of the antenna system and a printed electrically-conducting segment thereon; and a second printed circuit board component that includes a second connecting portion that is configured to engage the feed board, wherein the second printed circuit board component is configured to mount the first printed circuit board component to extend forwardly from the feed board, wherein the first connecting portion has a first tab and the second connecting portion has second and third tabs, one on each side of the first tab, wherein the first tab resides in a second engagement slot with an open rearward end in the second printed circuit board component, under a longitudinally extending first engagement slot with closed ends in the first printed circuit board component.

15. The antenna system of claim 14, wherein the first connecting portion is configured to extend in a first direction and the second connecting portion is configured to extend in a second direction that is different from the first direction.

16. The antenna system of claim 15, wherein the first tab is configured to be received within a first slot of the plurality of spaced apart slots in the feed board, wherein the second connecting portion comprises a second tab and a third tab that are configured to be received within a corresponding one of a second slot and a third slot of the plurality of spaced apart slots in the feed board, wherein the first slot extends in a first direction and the second and third slots reside on each side of the first slot and extend in a second direction that is different from the first direction, and wherein a first feed trace of the feed traces extends between the first slot and the second slot and a second feed trace of the feed traces extends between the first slot and the third slot.

17. The antenna system of claim 15, wherein the first slot extends in the first direction and the second slot extends in the second direction, and wherein the first direction and the second direction intersect at an angle of between 45° and 135°.

18. The antenna system of claim 17, wherein the first direction and the second direction intersect at an angle of between 80° and 100°, wherein the first printed circuit board component has a first engagement slot and the second printed circuit board components has a cooperating second engagement slot that couple the first and second printed circuit board components whereby first circuit board component intersects the second circuit board component with the first engagement slot being closed on each end and with the second engagement slot having an open rearward end and a closed forward end, wherein the second engagement slot has a first width extending perpendicular to a length dimension forward of first and second tabs of the second circuit board component and has a second larger width along a length of the first and second tabs, and wherein the first engagement slot has a width that is less than the first width.

19. The antenna system of claim 18, wherein the printed electrically-conducting segment is electrically floating.

20. An antenna system, comprising:

a feed board comprising feed traces and a plurality of spaced apart slots;

a plurality of spaced apart dipole radiating elements coupled to the feed board; and a plurality of isolators coupled to the feed board, wherein one isolator and first, second and third slots of the plurality of spaced apart slots are positioned between neighboring dipole radiating elements, wherein a first feed trace of the feed traces extends between the first slot and the second slot and a second feed trace of the feed traces extends between the first slot and the third slot, and wherein the isolators each comprise:

a first printed circuit board component that includes a first connecting portion that is configured to engage a feed board of the antenna system and an electrically-conducting segment thereon; and a second printed circuit board component that includes a second connecting portion that is configured to engage the feed board, wherein the second printed circuit board component is configured to mount the first printed circuit board component to extend forwardly from the feed board.

* * * * *